United States Patent [19]

Grenouillet

[11] Patent Number: 5,066,341

[45] Date of Patent: Nov. 19, 1991

[54] METHOD OF CONDITIONING AN ARTICLE OF SHAPE MEMORY METALLIC ALLOY HAVING TWO REVERSIBLE SHAPE MEMORY STATES

[75] Inventor: Guy Grenouillet, Villers-le-Lac, France

[73] Assignee: Nivarox-FAR S. A., Switzerland

[21] Appl. No.: 471,140

[22] Filed: Jan. 26, 1990

[30] Foreign Application Priority Data

Feb. 8, 1989 [CH] Switzerland ..... 00428/89

[51] Int. Cl.[5] ..... C21D 8/00

[52] U.S. Cl. ..... 148/11.5 C; 148/402

[58] Field of Search ..... 148/11.5 C, 402

[56] References Cited

U.S. PATENT DOCUMENTS 4,283,233 8/1981 Goldstein et al. ..... 148/11.5 R

FOREIGN PATENT DOCUMENTS 0035069 9/1981 European Pat. Off. .

0161952 12/1985 European Pat. Off. .

*Primary Examiner*—Richard O. Dean

*Assistant Examiner*—Robert R. Koehler

*Attorney, Agent, or Firm*—Weil Gotshal & Manges

[57] ABSTRACT

The method of conditioning an article of shape memory metallic alloy having a double-action shape memory in accordance with the invention comprises the operations of forming at ambient temperature the article to the shape constituting a first shape memory state, mechanically maintaining the article in its first shape memory state and heating the mechanically held article to a temperature to transform it into a state of the austenitic crystallographic phase, suddenly lowering the mechanically held article to a selected temperature and subjecting it to thermal stabilization treatment while still preserving its austenitic state, and subjecting the article to an education process in order to shape it into the second shape memory state.

8 Claims, 3 Drawing Sheets

METHOD OF CONDITIONING AN ARTICLE OF SHAPE MEMORY METALLIC ALLOY HAVING TWO REVERSIBLE SHAPE MEMORY STATES

BACKGROUND OF THE INVENTION

The invention relates to a method of conditioning an article of shape memory metallic alloy capable of undergoing reversible transformation from the crystallographic phase of the austenitic type to a crystallographic phase of the martensitic type, and in particular concerns the conditioning of articles having complex configurations with the aim of causing the articles to have a reversible memory of two shape memory states.

DESCRIPTION OF THE PRIOR ART

A method is already known from patent application EP-A-161 952 for conditioning an article in an alloy of the type mentioned above enabling a double reversible shape memory effect to be imparted to the article.

The method may be broken down into two series of operations, namely the preparation of the article to undergo the education process and the education process to which the actual article is subjected.

In fact, before putting the education process into effect it is necessary to prepare the article, this being initially in an undefined state of the crystallographic phase which does not permit an education process to be imparted to it. This preparation comprises essentially three successive operations, during the course of which the article is first shaped into a form constituting a first shape memory state, then heated in order to bring it into the austenitic phase state and finally cooled and stabilised at a temperature approximating ambient temperature.

This earlier method suffers from certain disadvantages when it is implemented.

FIELD OF THE INVENTION

It is especially difficult in this process of preparation to shape the articles precisely in their first shape memory state, the difficulty in obtaining a precise shape being all the greater the more complex the geometry of the article. This is explained by the fact that when the article is heated in order to attain its state of the austenitic phase, for safety reasons it is brought to a temperature slightly higher than the theoretical temperature for the onset of the occurrence of the monophase austenitic phase. Now this temperature is close to the melting temperature of the alloy and the result is that the article is in a state of softening in which it yields under its own weight and consequently loses its initial shape. This represents an important disadvantage in numerous applications such as the preparation of complex articles of thin section.

Moreover, the education process comprises the operations consisting successively of deforming the article in order to bring it into the shape constituting its second shape memory state by subjecting it, at ambient temperature, to a mechanical stress, subjecting this article under mechanical stress to a lowering of temperature so that it is transformed into a martensitic phase state, removing the mechanical stress, and heating the article so that it is again brought into an austenitic phase state so that it re-assumes the shape constituting its first shape memory state. This cycle may be repeated a number of times to improve the education process.

The education process described does not give entire satisfaction either. In fact the implementation of this method requires a large number of delicate handling operations, since during the course of each cycle it is necessary successively to impose a mechanical stress to the article and remove this mechanical stress. Imparting the education process to a series of articles is thus time consuming and consequently costly.

OBJECTS OF THE INVENTION

The principal object of the invention is therefore to overcome the disadvantages of the prior art mentioned above.

BRIEF SUMMARY OF THE INVENTION

It is therefore an object of the present invention to provide a method of conditioning an article of shape memory metallic alloy capable of undergoing reversible transformation from the crystallographic phase state of the austenitic type to the crystallographic phase state of the martensitic type for the reversible memorization of two shape memory states comprising the following operations shaping, at ambient temperature, the article to the shape constituting the first shape memory state, mechanically maintaining the article in its first shape memory state and heating the article held in this way to transform it into a state of the austenitic crystallographic phase, and subjecting the mechanically held article to a sudden lowering of temperature, then to thermal stabilisation treatment whilst still preserving its austenitic phase state, and subjecting the article to an education process in order to shape it into the second shape memory state.

Thus, in accordance with the method the article is prepared whilst being held in a shape corresponding precisely to its first shape memory state so that it keeps the initial desired shape, however complex its geometry.

According to one advantageous feature of the invention, the education process consists of subjecting the stabilised article in its austenitic state to a sudden lowering of temperature in order to transform the article into a martensitic state, whilst simultaneously subjecting it to a mechanical stress intended to shape it to the second shape memory state.

Preferably this education process comprises, moreover, an operation consisting of subjecting the article in its second shape memory state and held under the said mechanical stress, to a series of thermal stresses to bring the article alternately into a martensitic state and an austenitic state.

This thereby eliminates the various handling operations of putting the article under mechanical stresses at each stage of the known education cycle described above, so that the education process is simplified and made easier to perform.

Further features and advantages of the invention will become evident in the course of the detailed but not limitative description which follows from one possible method of implementing the method in accordance with the invention.

BRIEF DESCRIPTION OF THE DRAWINGS

This description will be given with reference to the attached drawings including.

DETAILED DESCRIPTION OF THE INVENTION

The method of conditioning in accordance with the invention permits the preparation and the education of articles made of shape memory metallic alloy with the aim of the reversible memorization by the latter of two shape memory states.

These articles are produced in known manner in metallic alloy of the type possessing the property of being capable of undergoing reversible transformation from their austenitic crystallographic phase state (high temperature) to the martensitic crystallographic phase state (low temperature).

With such alloys the transition from one phase state to the other occurs in one direction just like the other within a temperature range. The temperature at which the austenitic phase commences to appear in the heating of the alloy is termed As and the temperature at which the formation of the phase is completed is termed Af ($Af > As$). Similarly, in the cooling of the alloy, the temperatures of the transformation of the martensitic phase commencing and being completed are termed Ms and Mf respectively ($Mf < Ms$).

Generally speaking, it is to be noted that Ms and Mf are substantially lower than Af and As respectively, the temperature ranges [As, Af] and [Ms, Mf] being dependent upon the composition of the alloy.

A description will now be given in association with FIG. 1 of the method of conditioning an article P in accordance with the invention.

Figure 1:
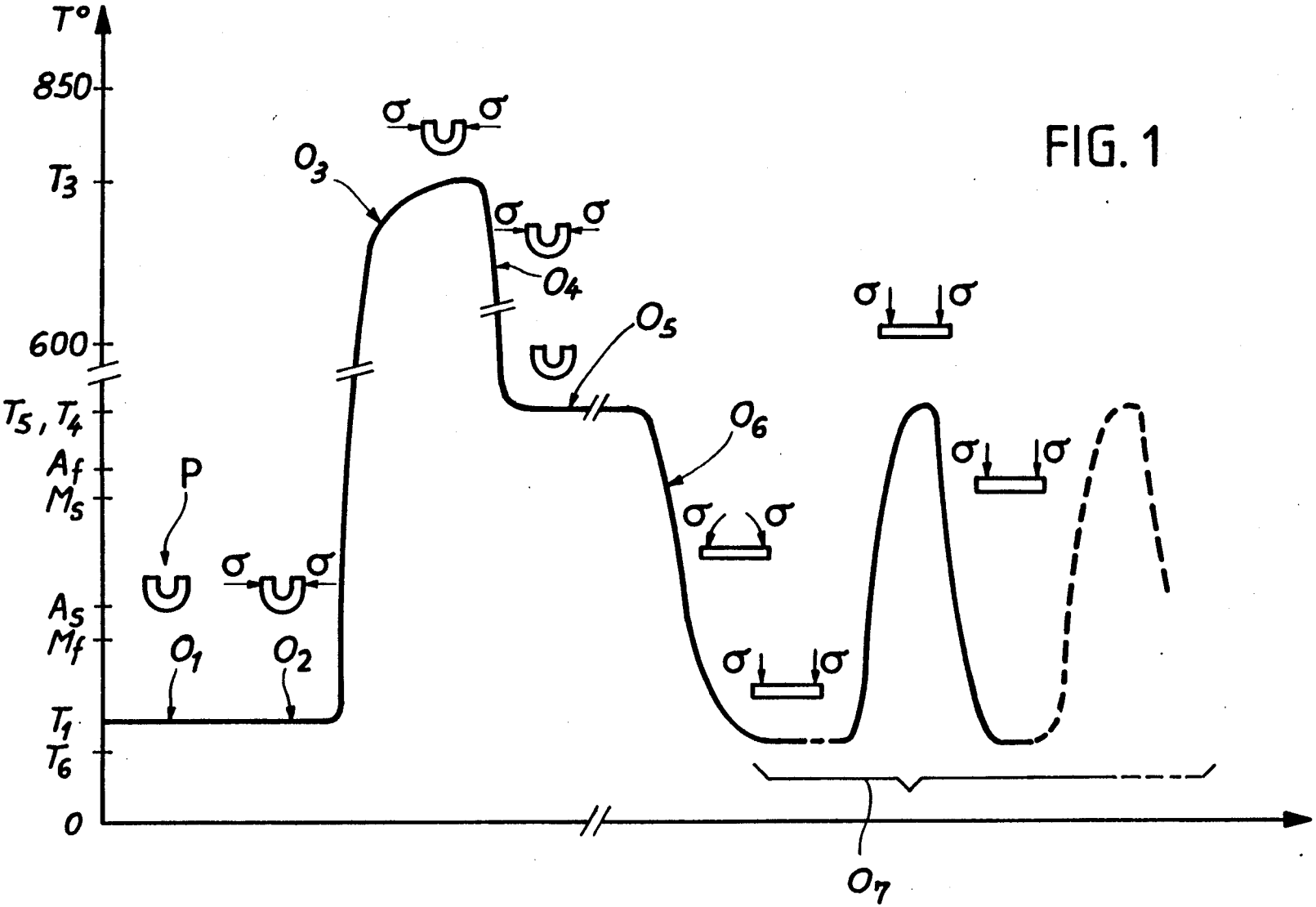
FIG. 1 shows a graph representing, as a function of time, the thermal treatments to which an article is subjected in the course of the implementation of the method in accordance with the invention, FIGS. 2 and 3 respectively show the shapes at high temperature and at low temperature of a spring produced in accordance with the method of the invention.

FIG. 1 is a graph in which the axis of the abcissae represents time and the axis of the ordinates represents temperature. This graph represents in diagram form the thermal cycles and the shapes of an article P to be treated, during the successive operations 01, 02 . . . 07 of the method.

The first two operations 01 and 02 are performed at ambient temperature T1, namely from 0° to 50° C. approximately. It is to be noted that the reference temperatures As, Af, Ms, Mf may be higher or lower than ambient temperature, depending on the metallic alloy used. These temperatures may be lower than 0° C., or higher than 0° C. as is has been shown on the graph.

In the course of operation 01 the article P is formed into a specific shape with the aid of suitable forming means. This shape which constitutes a first shape memory state corresponds to the shape of the article at high temperature.

Especially in the case of the initial shape of the article and the first shape memory state being very far apart it may be advantageous to perform the shaping of the article in a number of successive stages, each employing a particular shaping means to proceed progressively from the initial shape to the first shape state.

The article shaped in this way is then placed in a device in which it can be held under a mechanical stress $\sigma$ (tension, compression or other) and/or simply supported, by a jig for example, depending on the complexity of its geometry (operation 02). This retention or support prevents problems of elasticity inherent in the deformed article and problems of mechanical resistance of the article in the thermal treatments. The result is that the article retains precisely its first shape memory state.

The article is then subjected to a rise in temperature to bring it into a state of the austenitic crystallographic phase (operation 03). In this operation, the article is thoroughly heated to a temperature T3 within a range extending from about 600° to 850° C. depending on the alloy in question. This heating is carried out for example in a conventional chamber furnace, the latter having been previously heated.

In this respect it is to be noted that the time spent by the article in passage through the furnace must be as short as possible, taking account of the shape and size of the article, in order to avoid evaporation of the light metals in the alloy. In fact, such evaporation causes modification of the composition of the alloy and consequently significant modification of the thermal properties (transition points etc) and mechanical properties (elasticity limit etc) which risk modifying firstly the aptitude of the alloy to accept an education process and secondly the temperature limits within which the article can be used.

Consecutively with this heating process, the article still held and/or supported is subjected to sudden cooling down to a temperature T4 (operation 04). The lowering of temperature, performed by immersion for example, permits fixation of the austenitic phase. In all cases, the temperature T4 attained after cooling must be greater than the temperature Af otherwise the ability of the article to accept an education process is lost, the article in this case having passed through its austenitic-martensitic phase transformation zone without any change in shape. Moreover, the temperature T4 to which the article is cooled must be adopted so that any occurrence of a parasitic phase, in other words any phase other than the austenite or austenite-associated phase, is avoided.

Once the austenitic phase has been fixed, thermal stabilisation treatment of the article is performed (operation 05). This treatment consists of keeping the article for several tens of hours at a temperature T5 higher than Af and, for example, equal to the temperature T4 to which the article has previously been cooled. This treatment permits a structural reorganisation of the alloy and in particular allows the release of the internal stresses and elimination of the voids and other localised defects which could have appeared in the sudden cooling.

It will also be noted that during this stabilisation process it is possible to dispense with the holding and/or supporting of the article, since the article is already fixed in its first shape memory state.

It is essential to note that in order to preserve the possibility of imparting an education process to the article, the temperature of the article between the two operations 04 and 05 must remain several tens of degrees above the temperature Af.

Once the the resultant article has been stabilised in its first shape memory state, it can then be subjected to an education process.

The article prepared in accordance with the invention (operations 01 to 05) can be subjected to the education process described in patent application EP-A1-161

952. However, as mentioned above this education process requires the articles to undergo numerous handling operations, which makes it disadvantageous in the context of mass production.

To avoid these drawbacks it is advantageous to use, in accordance with the invention, an education process in which the article is first subjected to a sudden lowering of temperature to transform it into a martensitic state, whilst simultaneously imposing upon it a mechanical stress intended to shape it in the second shape memory state (operation 06). At this moment the article has already accepted the education process. Here, a lowering of temperature to transform the article into a martensitic state implies lowering to a temperature T6 lower than Mf.

In order to complete the education process on the article in accordance with the invention, the article may be subjected to a supplementary operation 07. This operation consists of subjecting the article mechanically held in its second shape memory state to a series of thermal stresses to bring it alternately from the martensitic state to the austenitic state. The resultant education process is all the more effective, the greater the number of thermal stresses and/or the higher the quality of the metallic alloy used.

A successive description in association with FIGS. 2 to 10 will now follow of the various operations of the method of conditioning in accordance with the invention applying the method to the treatment of a helicoidal spring for the purpose of imparting to the latter a memory for two shape memory positions.

Figure 2:
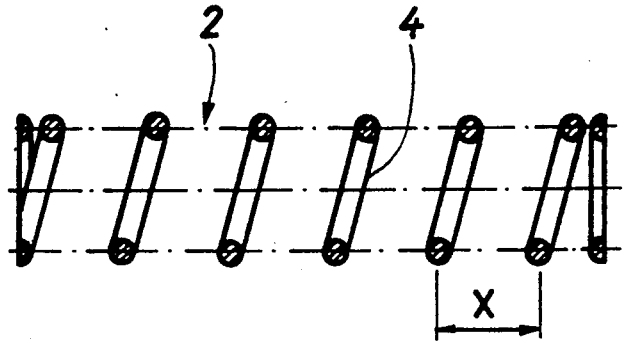
Figure 3:
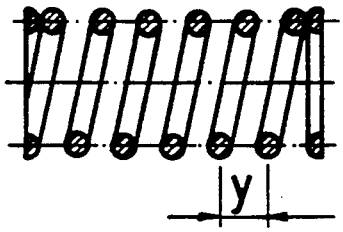

In FIGS. 2 and 3 a helicoidal spring 2 in its first and second shape memory states respectively is shown.

The first shape memory state corresponds to the shape of the spring at high temperature ($T>Af$) whereas the second state corresponds to the shape of the spring at low temperature ($T<Mf$).

In the example described, the spring 2 in its high temperature shape has coils 4 which are a distance X apart, and in its low temperature shape its coils are a distance Y apart, with $X>Y$. Of course the adoption of the shapes of articles at high and low temperatures is arbitrary and depends essentially on the application of the articles.

The alloy used in the production of the spring is, not limitatively, a shape memory metallic alloy comprising approximately 75% copper, 18% zinc and 7% aluminium and of which the phase transition temperatures are largely as follows: As=43° C., Af=68° C., Ms=56° C. and Mf=41° C.

Of course the compositions of the alloy may vary depending on whether a spring with higher or lower phase transition temperatures is required. It will also be noted that the method now to be described in greater detail is applicable to other shape memory alloys such as the alloys Ti+Ni, Ti+Ni+X, Cu +Al+X, Fe+X, etc. . . . X belonging to the whole range of metallic additives.

Referring more specifically to FIGS. 4 to 8, the spring 2 is seen at the different successive operations constituting preparation before its actual education process.

Figure 4:
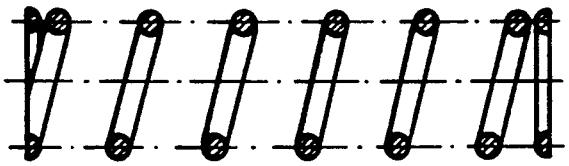
FIGS. 4 to 10 show the various shapes of the spring at the different stages of the method of conditioning in accordance with the invention.

FIG. 4 shows the spring at ambient temperature before its preparation. A shape has been imposed on this spring by rolling, or any other equivalent means, starting with a wire in shape memory alloy of the type previously described.

Figure 5:
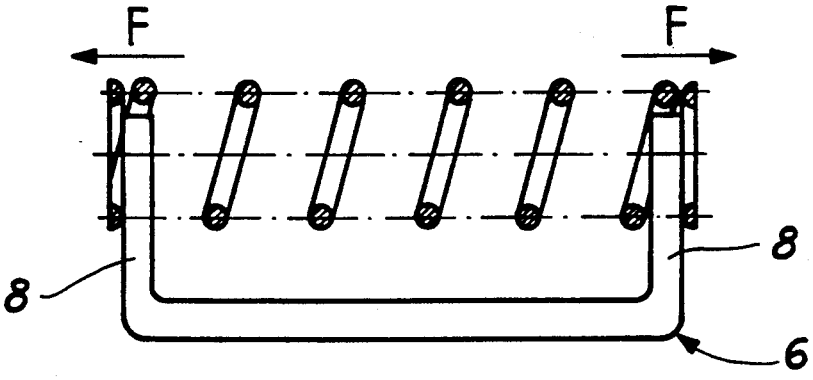

The subsequent operation, shown in FIG. 5, consists of imposing a tension F on the spring 2 at ambient temperature so that it assumes the shape corresponding to its first shape memory state. For this purpose, for example, the spring is attached by each of its two ends to a support device 6. This support can consist of a cradle, each of the edges 8 of the walls of this cradle being engaged between two coils of one end of the spring. For preference a support device is adopted having a thermal inertia lower than or equal to that of the spring so as not to interfere with effects of the subsequent thermal treatments. In the present example, the support has been produced from a grid in stainless steel in order to avoid any diffusion of the constituent materials of the support onto the article being treated.

It will be noted that advantageously, the use of a support such as a cradle permits the placing under tension of a large number of articles simultaneously.

Figure 6:
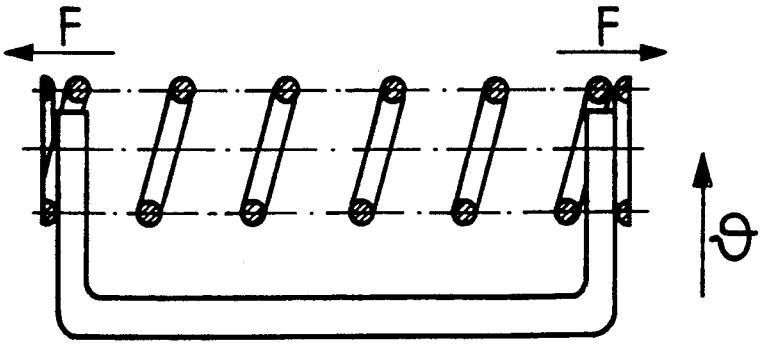

In the operation illustrated in FIG. 6 the spring 2 placed on the support (i.e. under tension) is subjected to a temperature of about 750° C. in order to transform the spring positively into the austenitic phase state.

For this purpose the spring is placed, for example, in a conventional chamber furnace, the furnace having been preheated for two hours to 750° C. The spring is then kept in the furnace for a few minutes, this time corresponding in fact to the time necessary for performing a thorough austenitic transformation of the spring. Consequently, the heating time depends upon the shapes and dimensions of the spring, and for the reasons already explained above, the heating time must be as short as possible.

In accordance with the method of the invention, it is advantageously noted that the spring preserves its shape during the course of heating, even at high temperature, the tension under which it is held preventing it from yielding despite the state of softening of the material at this temperature.

Figure 7:
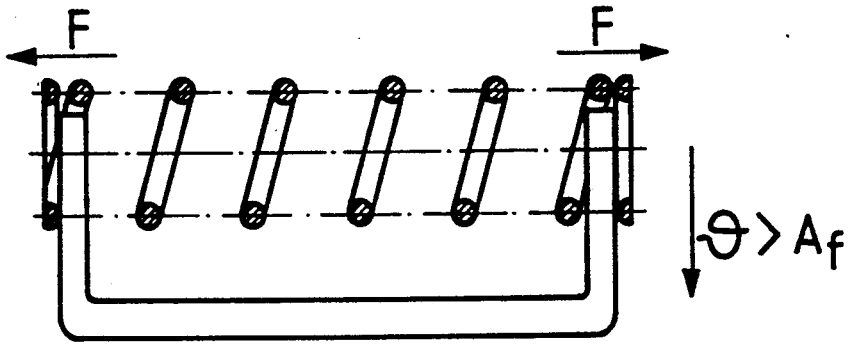
Figure 8:
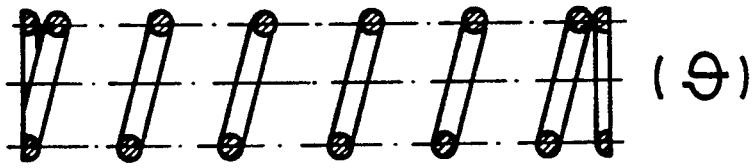

Following this operation, fixation of the austenitic phase is performed (FIG. 7). This fixation is carried out by cooling the article suddenly to a temperature higher than Af whilst avoiding the formation of parasitic phases. In the case of the spring, cooling is to a temperature 20° to 30° C. higher than the Af temperature of the alloy, namely to about 90° to 100° C.

This sudden lowering of temperature consists of quenching the spring in a bath thermostatically controlled at about 100° C. This bath contains a heat-exchange fluid having rapid homogeneous cooling characteristics. Preferably, in this temperature range oils of cryothermal types are used, for example a silicone oil of the type sold under the brand name Rhodorsil manufactured by Rhone Poulenc.

In the case where shape memory metallic alloys are used having transition temperatures lower than 0° C., it will be easily possible to perform immersion in water at ambient temperature.

Once the operation described above has been completed it is then necessary to eliminate the localised defects and the internal stresses inherent in sudden cooling.

For this purpose, the spring 2 is subjected to thermal stabilisation treatment (FIG. 8) in order to reorganise the crystalline structure of the alloy and to release the internal stresses This treatment consists of keeping the spring for 10 to 20 hours in the bath in which it has been cooled, the spring not having been taken out after the preceding stage. Since the shape of the spring in its first shape memory state has been fixed at the same time as the quenching, it is then no longer necessary to keep the spring under tension.

Figure 9:
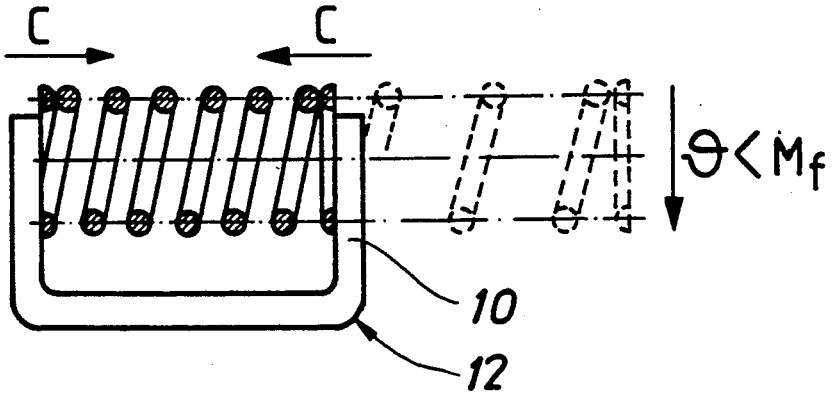
Figure 10:
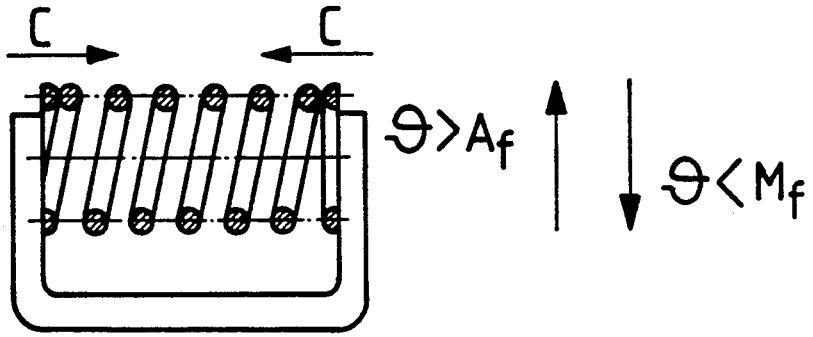

Once the preparation of the article is completed, the education process of the spring illustrated in FIGS. 9 and 10 is undertaken.

FIG. 9 shows the essential education operation, the education process consisting of simultaneously subjecting the spring 2 firstly to a mechanical compression stress C, in order to shape it into its second shape memory state, and secondly to a sudden lowering of temperature, namely to a temperature lower than Mf. In the case of the alloy selected, the spring undergoes a quench of the type termed martensitic at a temperature in the range between 0° and 20° C., the spring being gripped for example between the edges 10 of a cradle 12 so as to reduce the distance between its coils. Preferably, the shape of the spring in its low temperature form is obtained within the temperature range between Af and Mf.

Finally the spring, whilst remaining subjected to the above mentioned mechanical stress, is alternately heated to a temperature higher than Af, i.e. 90° to 110° C., then suddenly cooled to a temperature lower than Mf, i.e. from 0° to 20° C. for the alloy in question, this being repeated several tens of times.

Advantageously, the support enabling the spring to be held under stress in its second shape memory state, is designed to permit the education process to be applied to a large number of springs simultaneously. Thus the handling of springs inherent in the method of prior art described above is eliminated.

I claim:

1. A method of conditioning an article made from metallic alloy capable of undergoing reversible transformation from the crystallographic phase state of the austenitic type to the crystallographic phase state of the martensitic type for causing the article to have a reversible memory of two shape memory states, which comprises:

holding the article under a mechanical stress at ambient temperature in the form constituting the first shape memory state, maintaining the article under a mechanical stress in its first shape memory state while heating the mechanically held article to transform it into a state of the austenitic crystallographic phase while the article remains in its first shape memory state, subjecting the article held under such mechanically stress in its first shape memory state to a sudden lowering of temperature and to thermal stabilization treatment, while preserving its austenitic state, and subjecting the article to an education process in order to shape it into the second shape memory state.

2. A method in accordance with claim 1, wherein the education process comprises subjecting the article stabilised in its austenitic state to a sudden lowering of temperature to transform the article into a martensitic state while simultaneously imposing upon it a mechanical stress to shape the article into the second shape memory state.

3. A method in accordance with claim 2 wherein the education process further comprises subjecting the article while mechanically maintained in its second shape memory state to a series of thermal cycles for transforming the article alternatively back and forth between a martensitic state and an austenitic state.

4. A method in accordance with claim 1, 2 or 3 including shaping the article at ambient temperature in a number of successive forming operations to pass progressively from an initial shape of the article to the first shape memory state.

5. A method in accordance with claim 1, 2 or 3 wherein the operation during which the mechanically held article is subjected to a sudden lowering of temperature and to a thermal stabilisation treatment comprises suddenly subjecting the article to a temperature substantially higher than the temperature (Ms) of onset of formation of the martensitic phase to fix the austenitic phase and maintaining the article at this temperature for 10 to 20 hours.

6. A method in accordance with claim 2 or 3 wherein, the education process, the mechanical stress for shaping the article into the second shape memory state is imposed on the article between the temperatures of the onset (Ms) and termination (Mf) of the martensitic phase.

7. A method in accordance with claim 1, 2 or 3 wherein in the operation during which the article is first subjected to a thermal treatment to transform it into a state of the austenitic crystallographic phase, the article is brought to a temperature close to 800° C. and is maintained at this temperature between 1 to 60 minutes.

8. A method of conditioning an article made from metallic alloy capable of undergoing reversible transformation from the crystallographic phase state of the austenitic type to the crystallographic phase state of the martensitic type for causing the article to have a reversible memory of two shape memory states, which comprises:

shaping the article at ambient temperature to the form constituting the first shape memory state, heating the article to transform it into a state of the austenitic crystallographic phase while the article remains in its first shape memory state, subjecting the article while in its first shape memory state to a sudden lowering of temperature and to a thermal stabilization treatment, while preserving its austenitic state, subjecting the article stabilized in its austenitic shape to a sudden lowering of temperature to transform the article into a martensitic state while simultaneously imposing upon it a mechanical stress to shape the article into the second shape memory state, and subjecting the article while mechanically maintained in its second shape memory state to a plurality of thermal cycles for transforming the article alternatively back and forth between a martensitic state and an austenitic state.

* * * * *